US006260985B1

(12) United States Patent
Zeller

(10) Patent No.: US 6,260,985 B1
(45) Date of Patent: Jul. 17, 2001

(54) MULTIPURPOSE PORTABLE ELECTRIC LIGHTING APPARATUS

(76) Inventor: Noel E. Zeller, 65 Haven Ave., Mount Vernon, NY (US) 10553

( * ) Notice: Subject to any disclaimer, the term of this patent is extended or adjusted under 35 U.S.C. 154(b) by 0 days.

(21) Appl. No.: 09/360,037

(22) Filed: Jul. 23, 1999

(51) Int. Cl.[7] ..... F21L 5/00

(52) U.S. Cl. ..... 362/202; 362/197; 362/198; 362/199; 362/194; 362/184; 362/208; 362/157; 362/200

(58) Field of Search ..... 362/197, 198, 362/199, 194, 184, 208, 157, 200

(56) References Cited

U.S. PATENT DOCUMENTS

| | | | | |
|---|---|---|---|---|
| D. 293,825 | | 1/1988 | Jennings | D26/50 |
| D. 296,827 | | 7/1988 | Yuen | D26/44 |
| D. 297,372 | | 8/1988 | Poon | D26/44 |
| D. 310,574 | | 9/1990 | Trattner | D26/44 |
| D. 337,840 | | 7/1993 | Ekeroth | D26/44 |
| D. 344,358 | | 2/1994 | Yuen | D26/38 |
| D. 373,436 | | 9/1996 | Li et al. | D26/44 |
| D. 375,375 | | 11/1996 | Poon | D26/44 |
| D. 409,778 | | 5/1999 | Chu | D26/44 |
| D. 413,993 | | 9/1999 | Yuen | D26/44 |
| 3,030,497 | * | 4/1962 | Cheng | 362/197 |
| 5,217,297 | * | 6/1993 | Yeun | 362/184 |
| 5,558,430 | * | 9/1996 | Booty, Jr. | 362/184 |
| 5,859,582 | * | 1/1999 | Yuen | 362/184 |
| 5,967,643 | * | 10/1999 | Chan | 362/208 |
| 5,971,562 | * | 10/1999 | Yang | 362/184 |
| 6,027,224 | * | 2/2000 | Schnell | 362/119 |
| 6,056,414 | * | 5/2000 | Kreiger | 362/184 |
| 6,132,071 | * | 5/2000 | yuen | 362/427 |

* cited by examiner

*Primary Examiner*—Stephen Husar
*Assistant Examiner*—Anabel M Ton
(74) *Attorney, Agent, or Firm*—Cooper & Dunham LLP; Donald S. Dowden

(57) ABSTRACT

Portable lighting apparatus includes heavy-duty light formed with a pouch and a small light that can be inserted into or withdrawn from the pouch. The two lights can be used together or separately. Each of the lights can assume multiple configurations, and the two lights can be used together or separately.

12 Claims, 20 Drawing Sheets

MULTIPURPOSE PORTABLE ELECTRIC LIGHTING APPARATUS

BACKGROUND OF THE INVENTION

FIELD OF THE INVENTION

This invention relates to portable electric lighting apparatus and, more particularly, to novel such apparatus that serves an extraordinary number of different purposes.

Flashlights and other portable electric lighting apparatus have been known for many decades and have reached a high state of development. Improvements in battery and bulb technology have resulted in flashlights that produce a substantial light output over an extended time period. Focusing devices make it possible to provide flood lighting or spot lighting, interchangeable lenses make it possible to provide lighting of different colors, and multiposition switches make it possible to provide blinking and other operating modes in addition to the basic on and off modes.

The extended and assiduous development of portable electric lights, which continues to this day, attests to the important purposes they serve. Portable electric lights of different specifications are needed, for use especially at night but often during the day:

- during commercial power outages;
- at home and in the family car to search in basements, attics, closets, drawers, glove compartments and trunks;
- at campsites, while hiking or biking on trails, and in other areas away from commercial electrical power outlets;
- to enable repair of cars, boats and bicycles;
- to find keyholes and operate combination locks.

Indeed, portable electric lights have become indispensable in modern society, so that people today often have many of them, which are stored at various locations around the house and office or other place of business, in cars, trucks, and boats and in pockets, purses, luggage and backpacks.

While portable electric lights are highly evolved and represent good value, no single light developed heretofore is suitable for all of the purposes summarized above. For example, lights that are bright enough for use at long distances tend to be fairly bulky and heavy and not ideally suited for carrying for extended periods of time; and lights that are small enough to carry in a pocket or purse tend to be too dim for use at long distances.

Some conventional portable electric lights have two units that are connected together but operate independently of each other. While that broadens the range of possible lighting applications, it does nothing to address the problem of bulk and weight.

What is needed is portable electric lighting apparatus that provides the brightness and ruggedness of a heavy-duty flashlight while maintaining the convenience of a penlight or pocket flashlight.

OBJECTS AND SUMMARY OF THE INVENTION

An object of the invention is to provide portable electric lighting apparatus that avoids the problems of the prior art noted above. In particular, an object of the invention is to provide in a single package portable electric lighting apparatus that can serve virtually every purpose that any flashlight or portable electric lantern can serve, including the ones mentioned above.

Another object of the invention is to provide portable electric lighting apparatus that is as bright and rugged as a heavy-duty flashlight yet where the need arises is as convenient as a penlight or pocket flashlight and can easily be carried in a pocket or purse.

Another object of the invention is to provide such lighting apparatus that is capable of operating in a plurality of modes independently and simultaneously.

BRIEF DESCRIPTION OF THE DRAWINGS

Other objects of the invention, as well as various features and advantage thereof, will become apparent from the following detailed description of the preferred embodiments thereof, and from the appended figures of the drawing, wherein.

DESCRIPTION OF THE PREFERRED EMBODIMENTS

Figure 1:
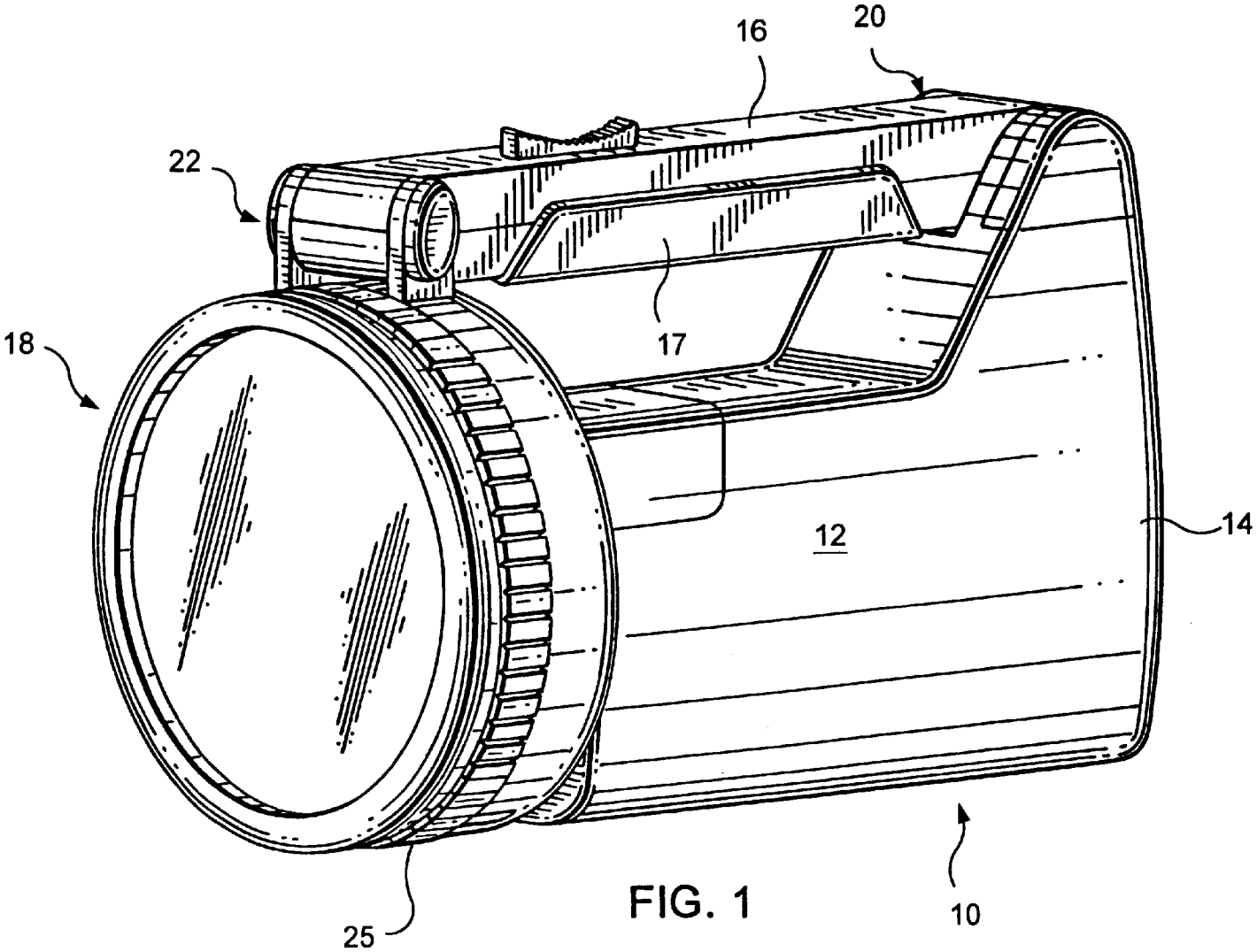
FIG. 1 is a top-front-right perspective view of a preferred embodiment of portable electric lighting apparatus constructed in accordance with the invention and showing a first lighting unit in a first configuration.

The figures show a first unit 10 and a second unit 100 that can be connected together to form a single package 12 or separated so that either unit can be used independently of the other. When the two units 10 and 100 are connected together to form a single package 12, it is within the scope of the invention to enable operation of the two units 10 and 100 independently of each other. It is also within the scope of the invention to provide a control (not shown) on one of the lighting units, such as the first unit 10, for operating the other lighting unit, for example the unit 100, when the two units 10 and 100 are connected together to form the package 12.

Figure 13:
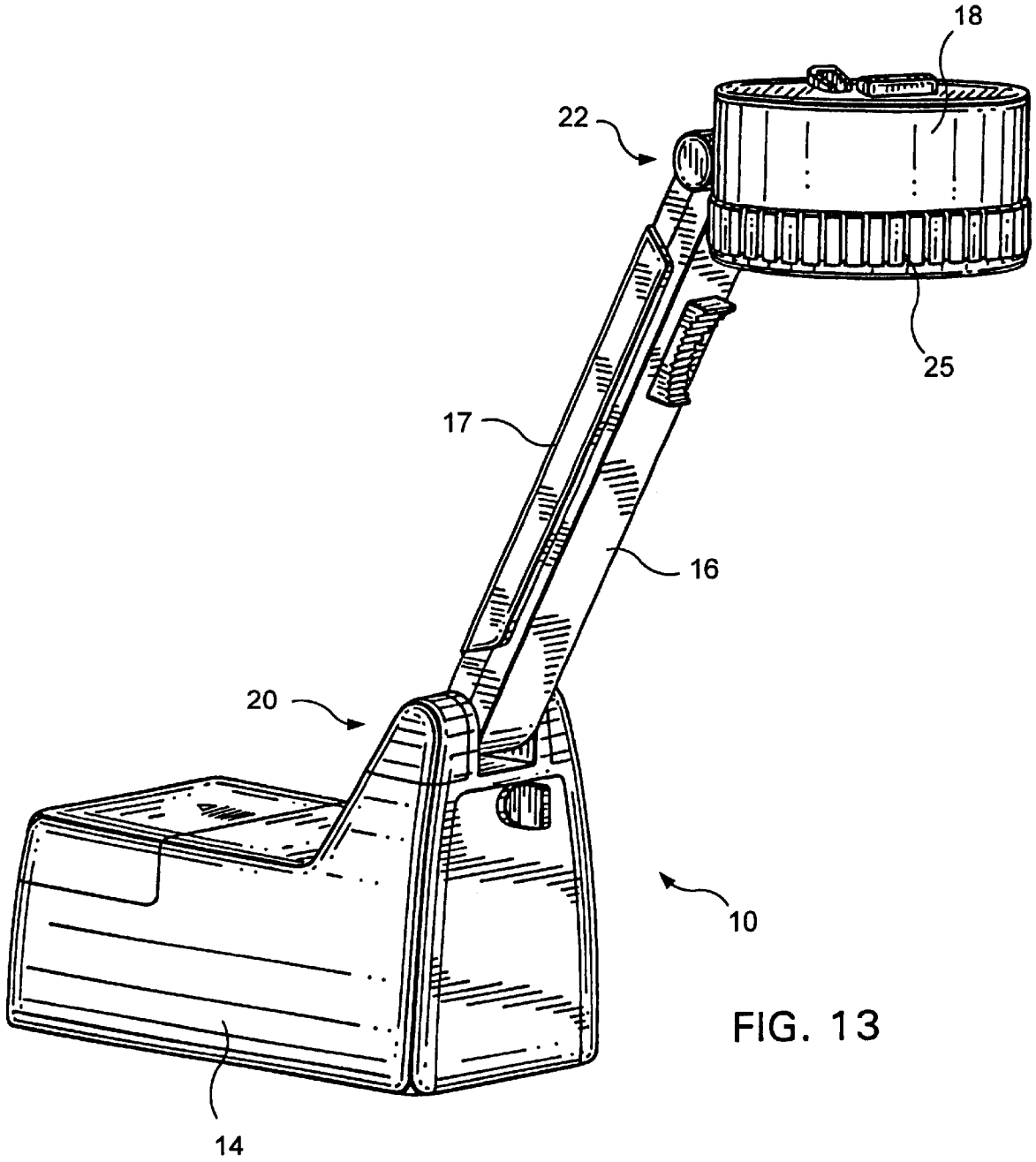
FIG. 13 is a top-rear-right perspective view thereof, showing the first unit in a third configuration.
Figure 14:
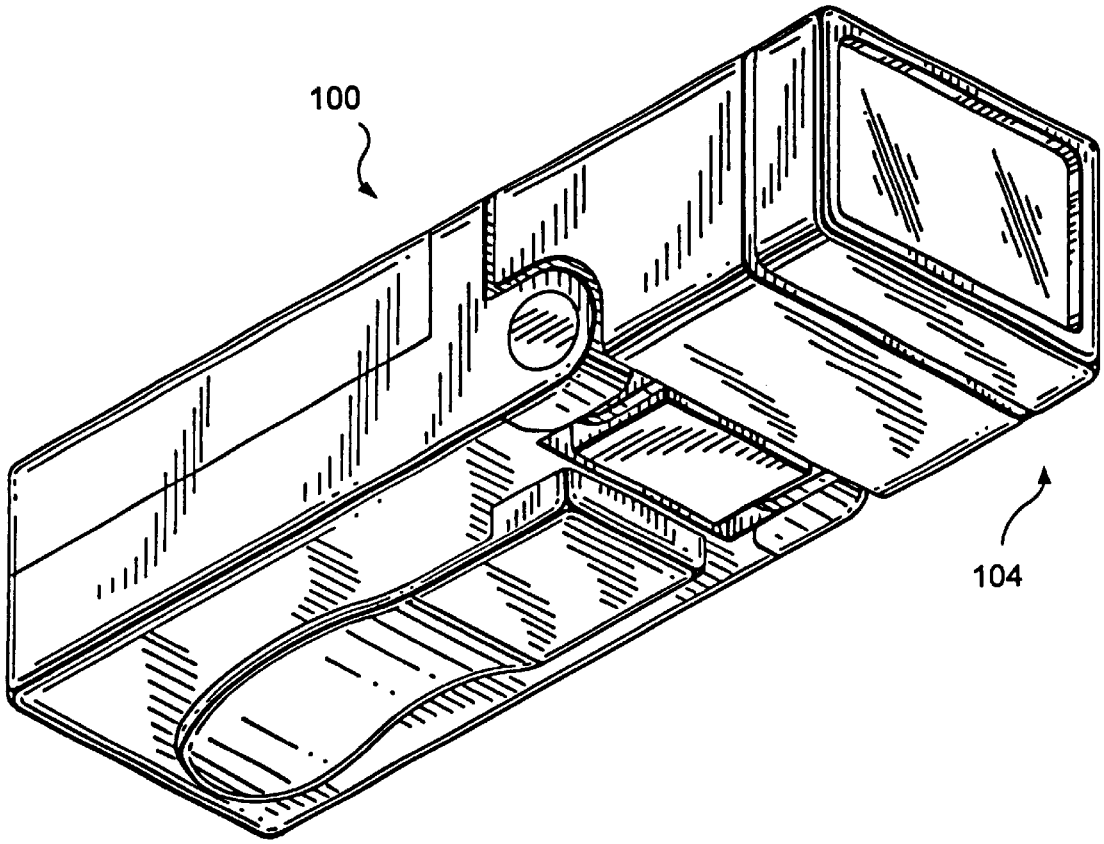
FIG. 14 is a bottom-front-left perspective view of a preferred embodiment of the second lighting unit in a first configuration.
Figure 15:
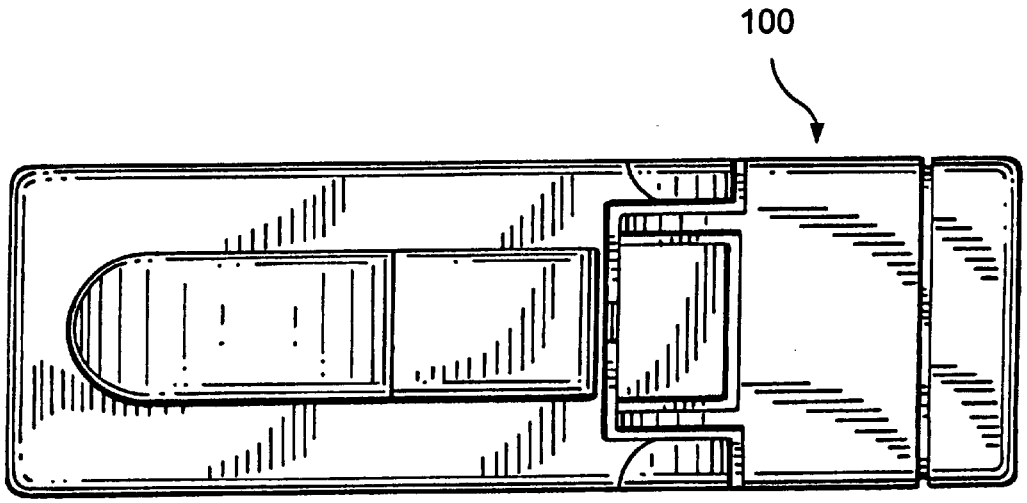
FIG. 15 is a bottom view thereof.
Figure 16:
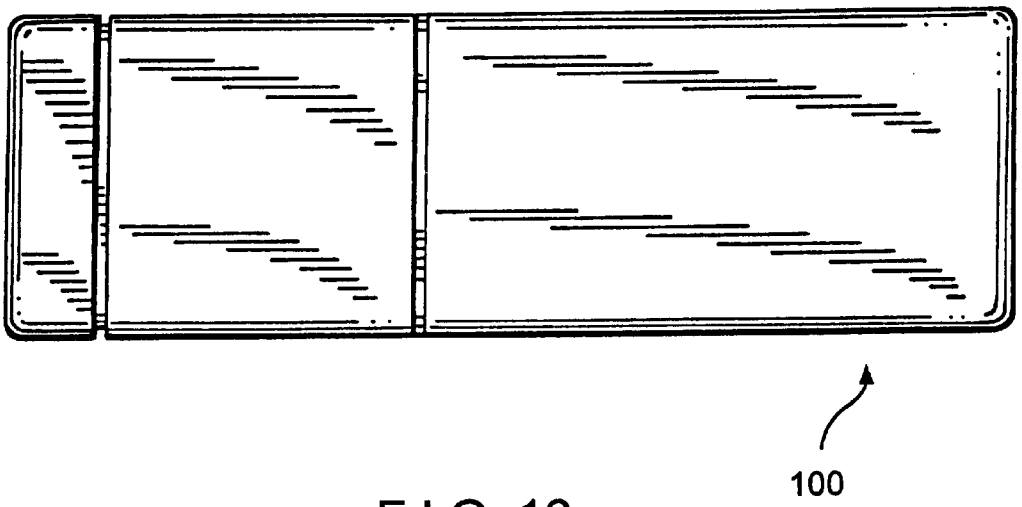
FIG. 16 is a top view thereof.
Figure 17:
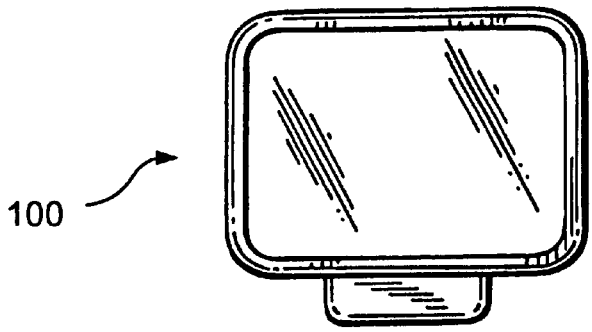
FIG. 17 is a front view thereof.
Figure 18:
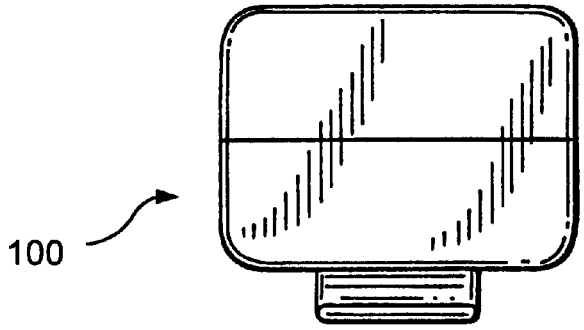
FIG. 18 is a rear view thereof.
Figure 19:
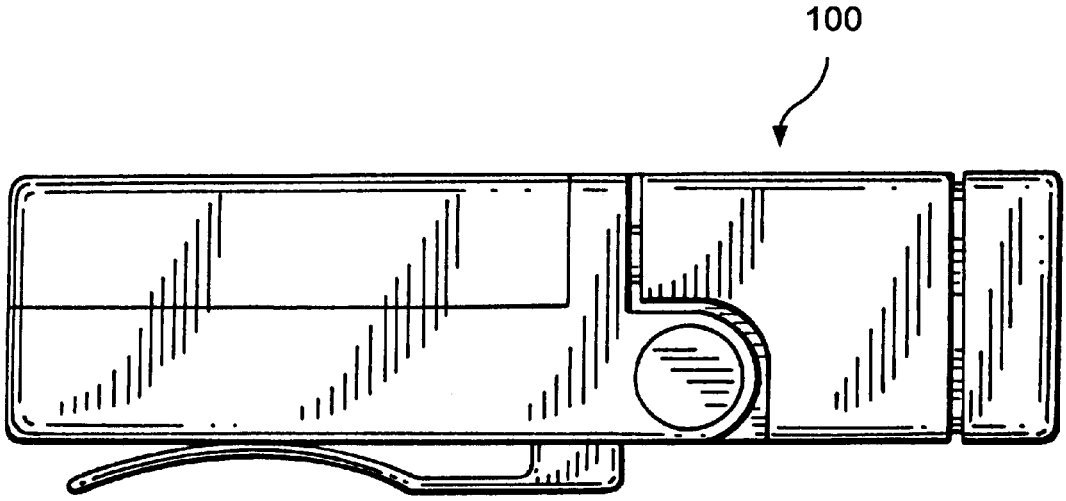
FIG. 19 is a left-side view thereof.
Figure 20:
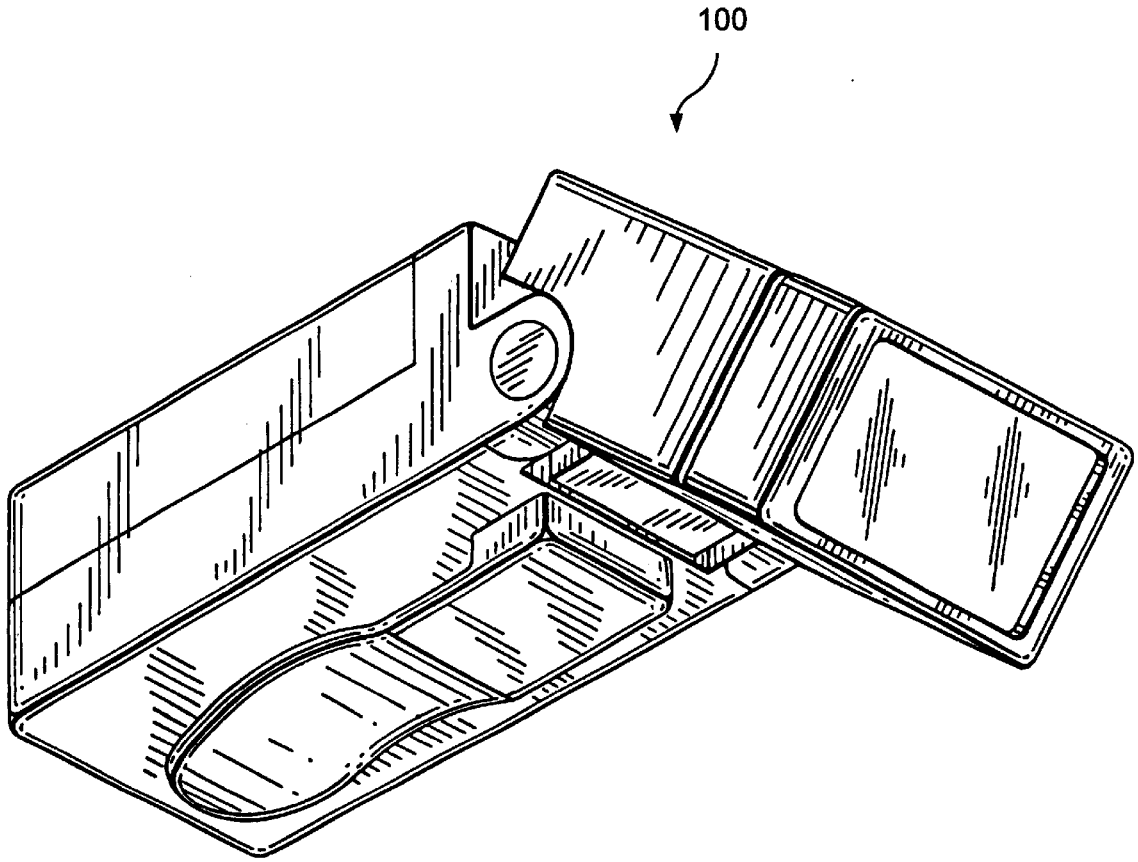
FIG. 20 is a bottom-front-left perspective view thereof, showing it in a second configuration.

The unit 10 has a housing 14, a handle 16 provided with a non-slip grip 17, and a head 18. The handle 16 is pivotally mounted on the housing 14 at the proximal end 20 of the handle, and the head 18 is pivotally mounted on the handle 16 at the distal end 22 of the handle. The handle can then be pivoted relative to the housing and the head relative to the handle so that the unit 10 can assume any of the configurations shown in the figures, thereby redirecting the light as may be desired, and myriad other configurations that are not separately illustrated but will be apparent to those skilled in the art. In particular:

FIGS. 1–6 illustrate a first configuration of the unit 10,

FIGS. 7–12 illustrate a second configuration,

FIG. 13 illustrates a third configuration, and

Figure 22:
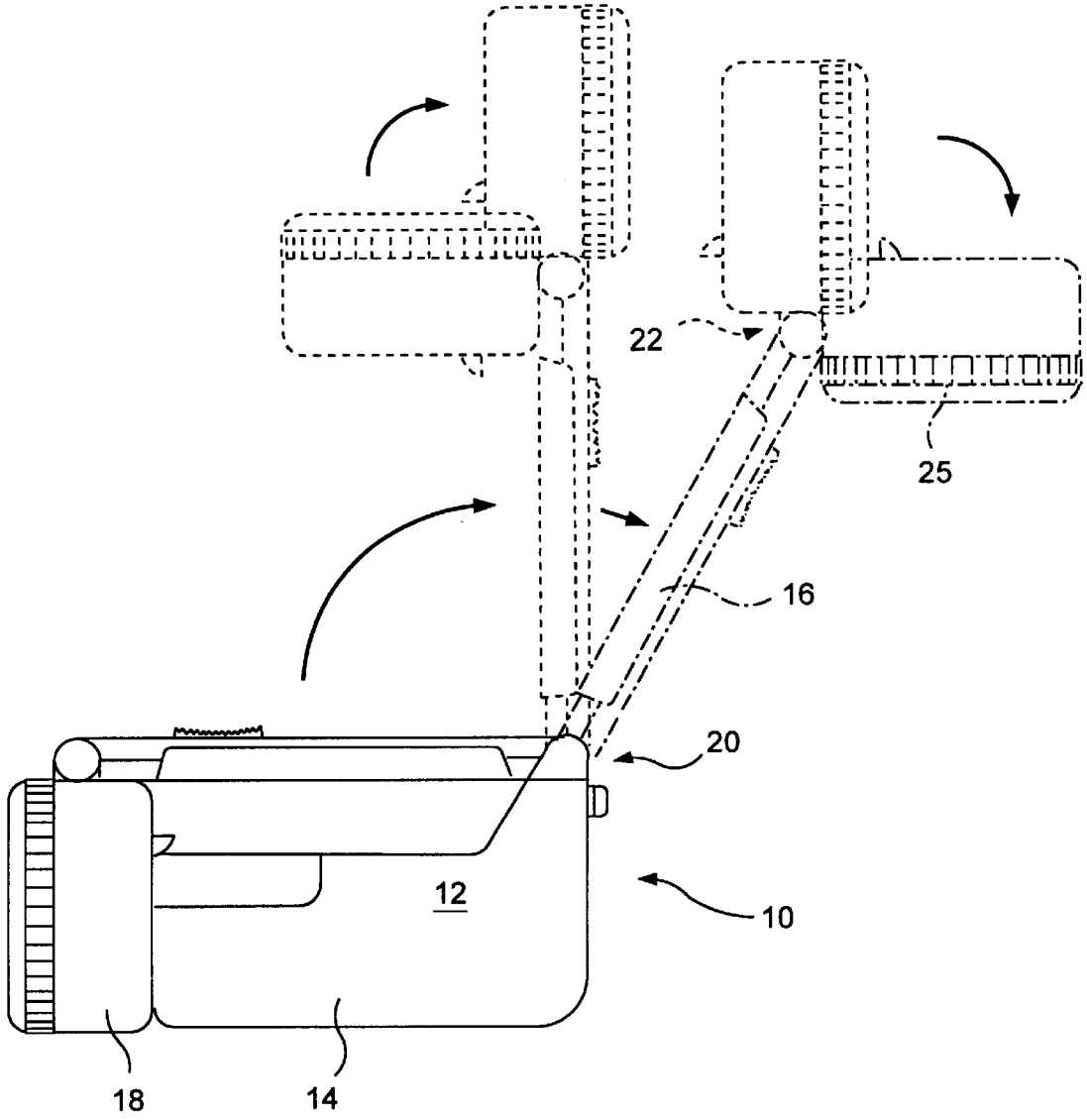
FIG. 22 is a right-side view showing a plurality of configurations that the first unit can assume.
Figure 23:
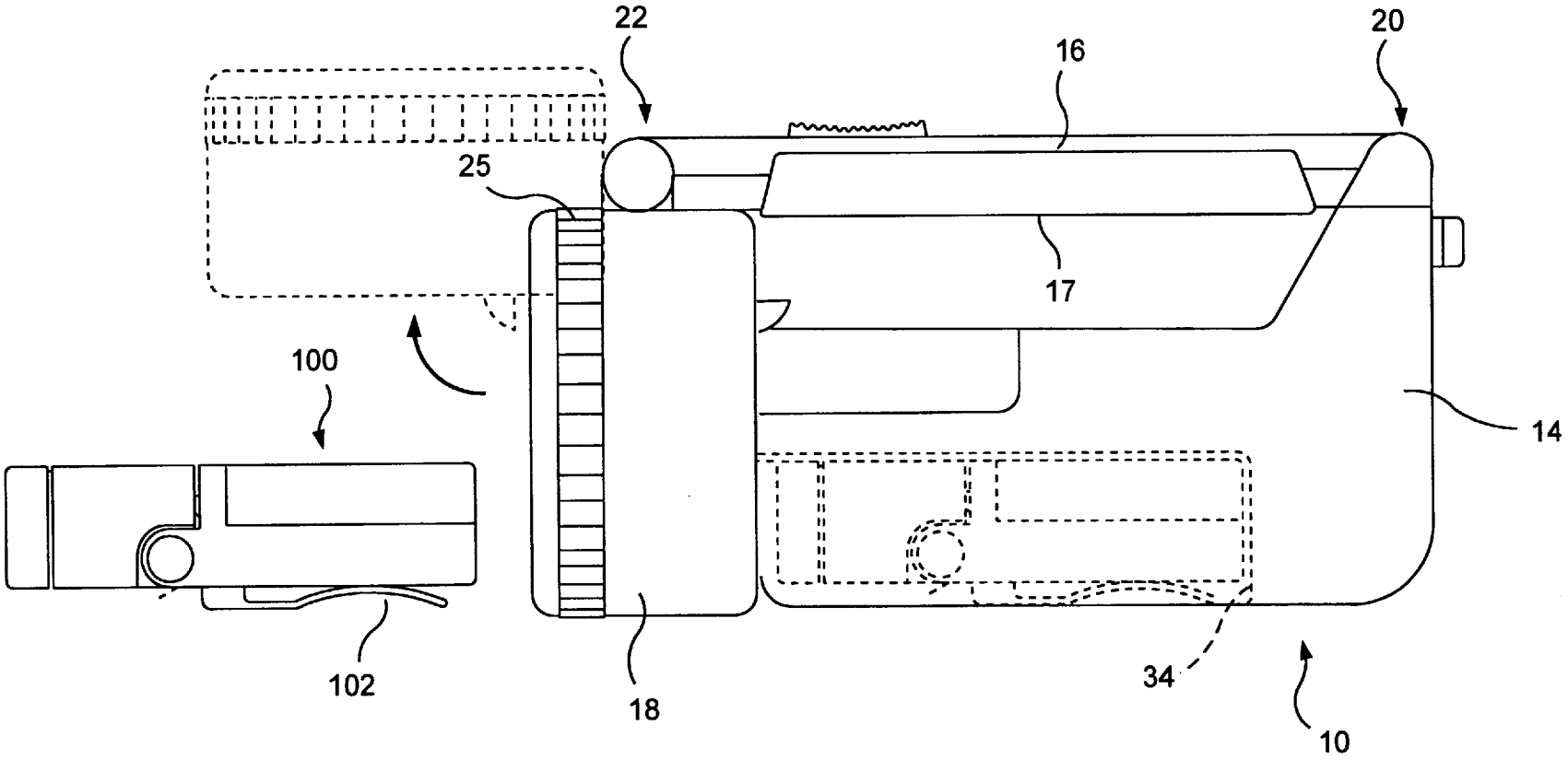
FIG. 23 is a right-side view showing a plurality of configurations that the first unit can assume and illustrating how the second unit can be inserted into or withdrawn from the first unit.

FIGS. 22 and 23 illustrate others.

Figure 2:
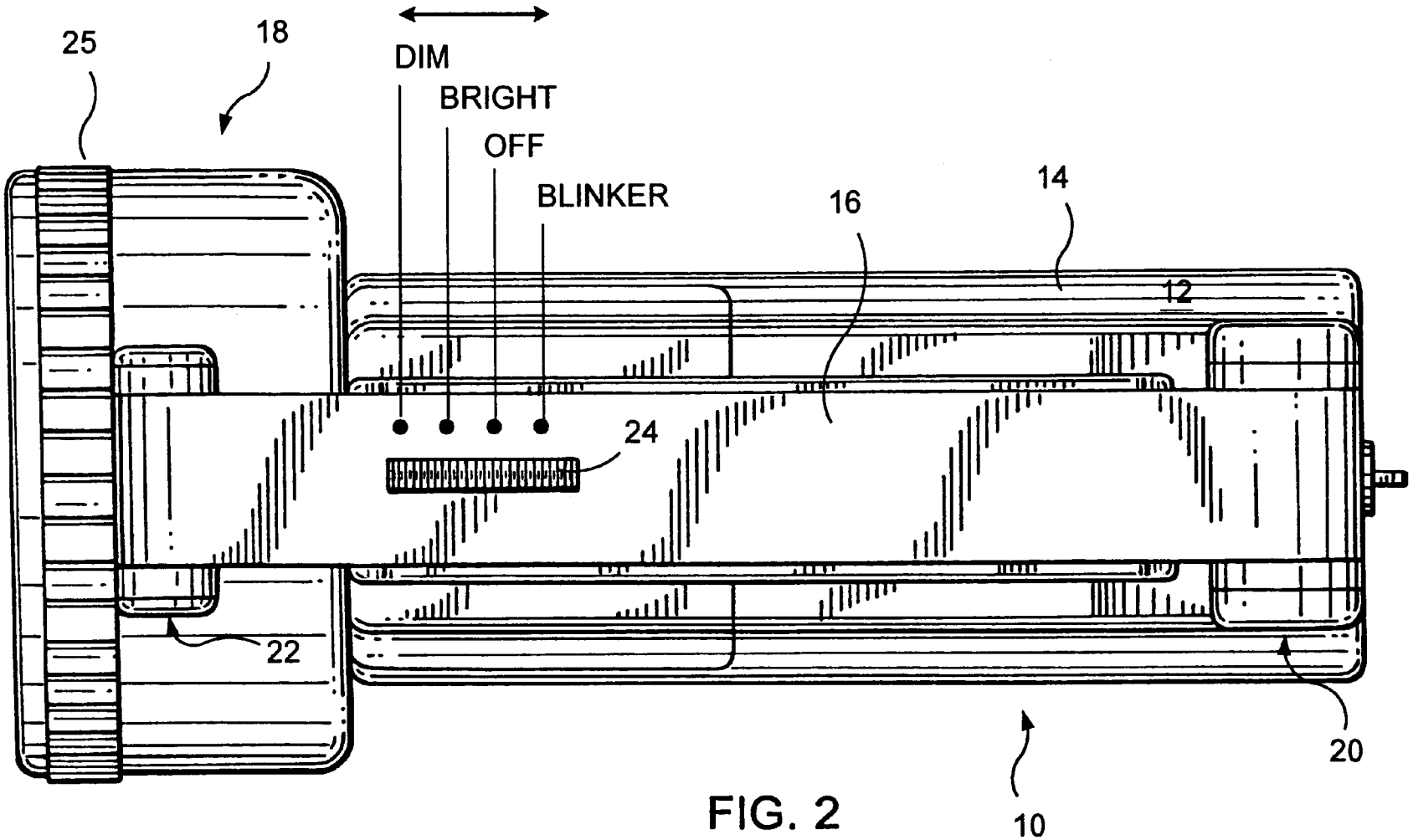
FIG. 2 is a top view thereof.
Figure 3:
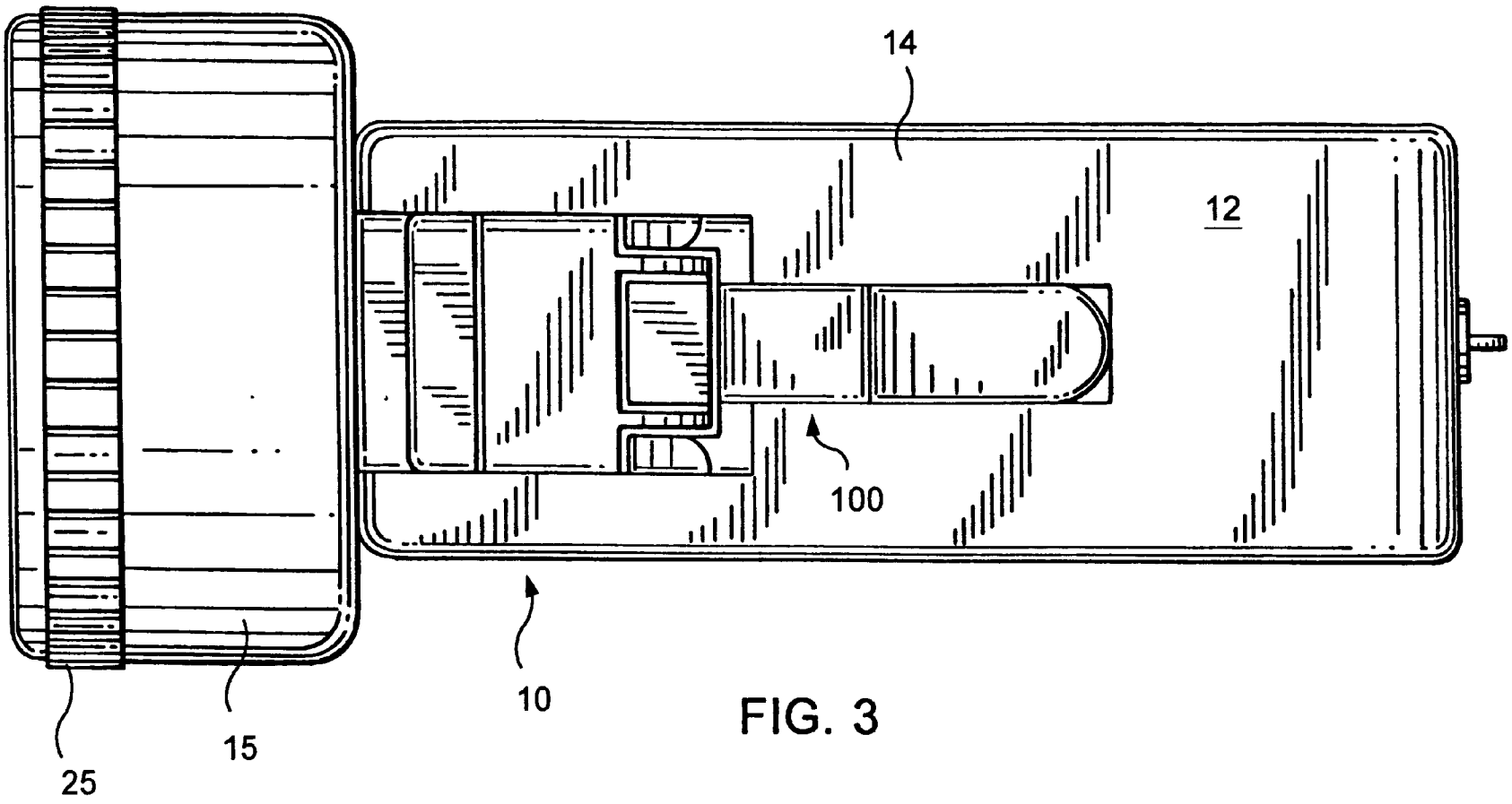
FIG. 3 is a bottom view thereof showing a second lighting unit in addition to the first lighting unit mentioned above.
Figure 4:
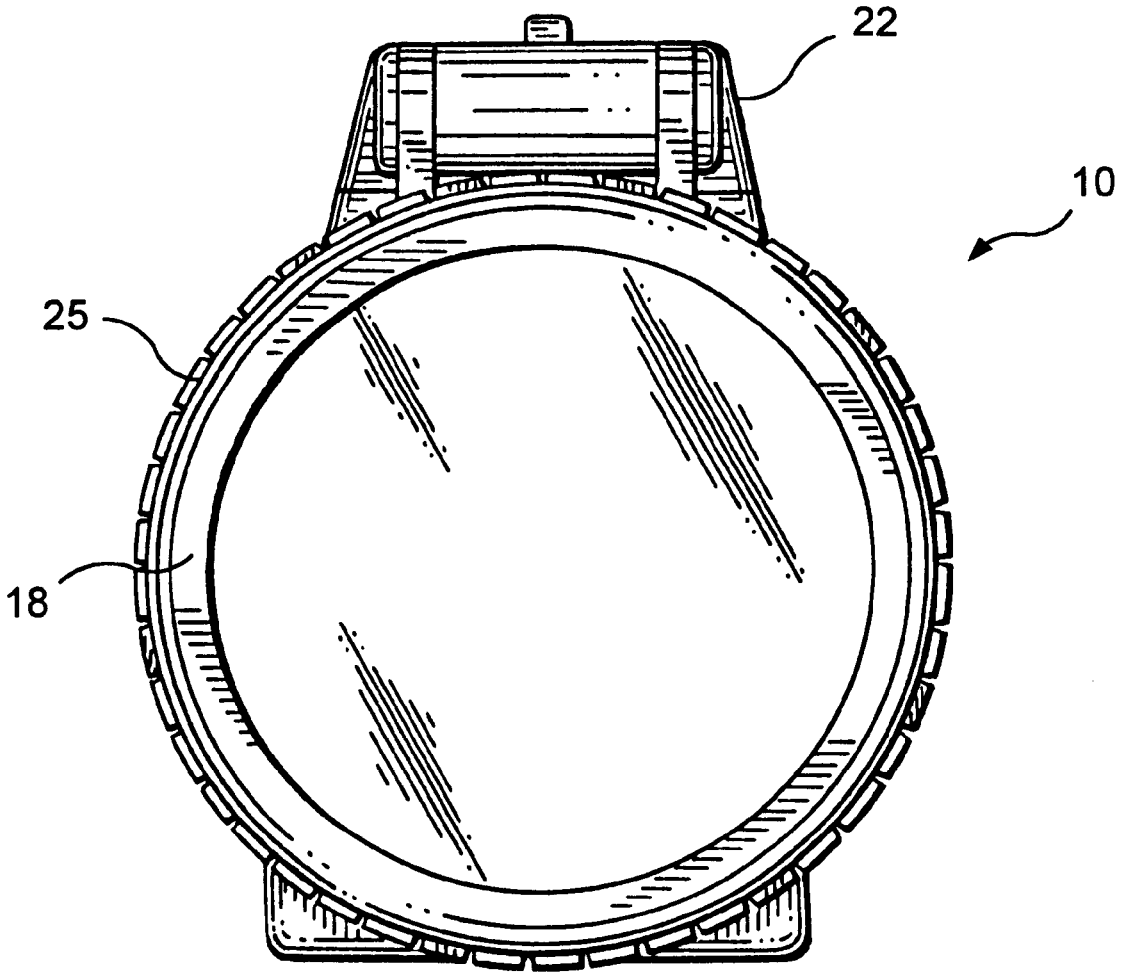
FIG. 4 is a front view thereof.
Figure 5:
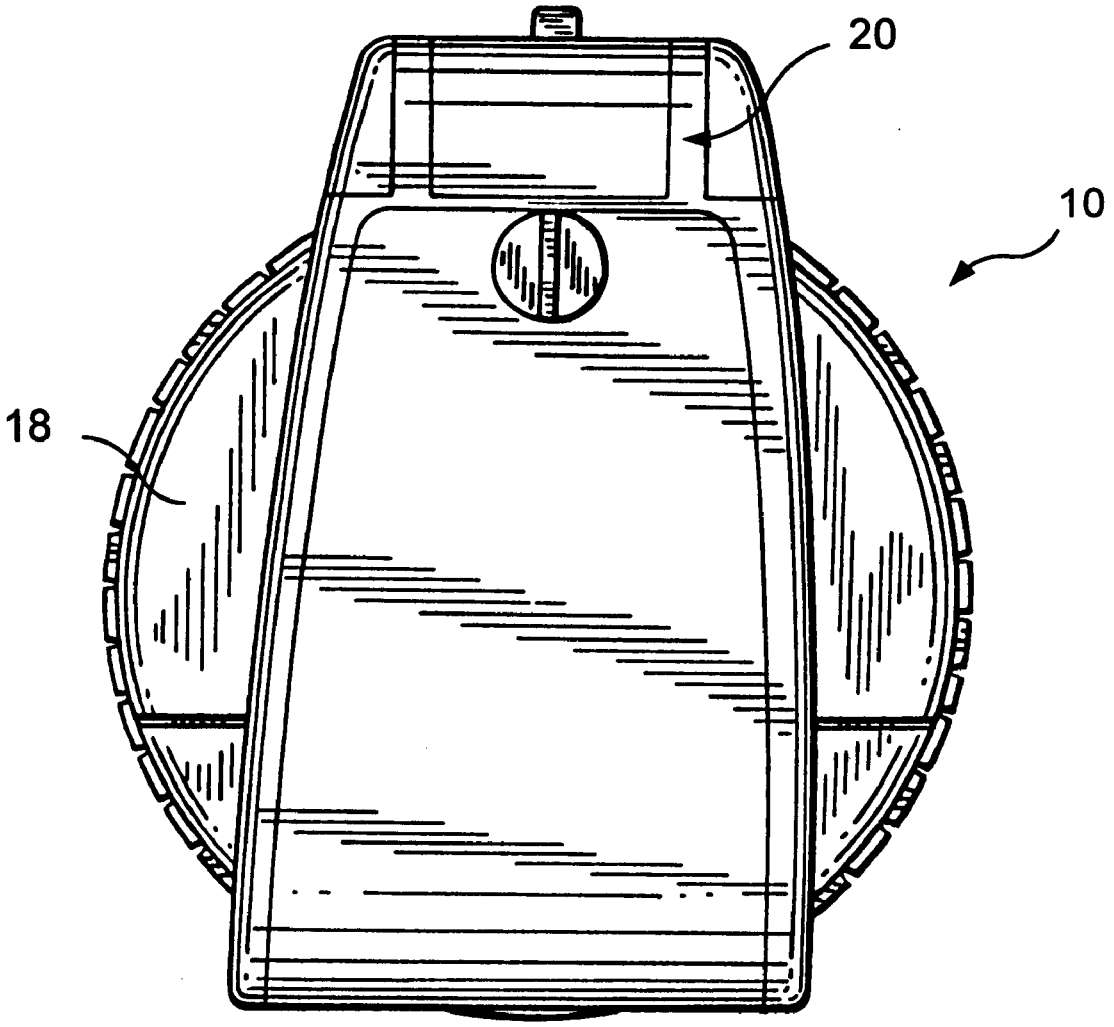
FIG. 5 is a rear view thereof.
Figure 6:
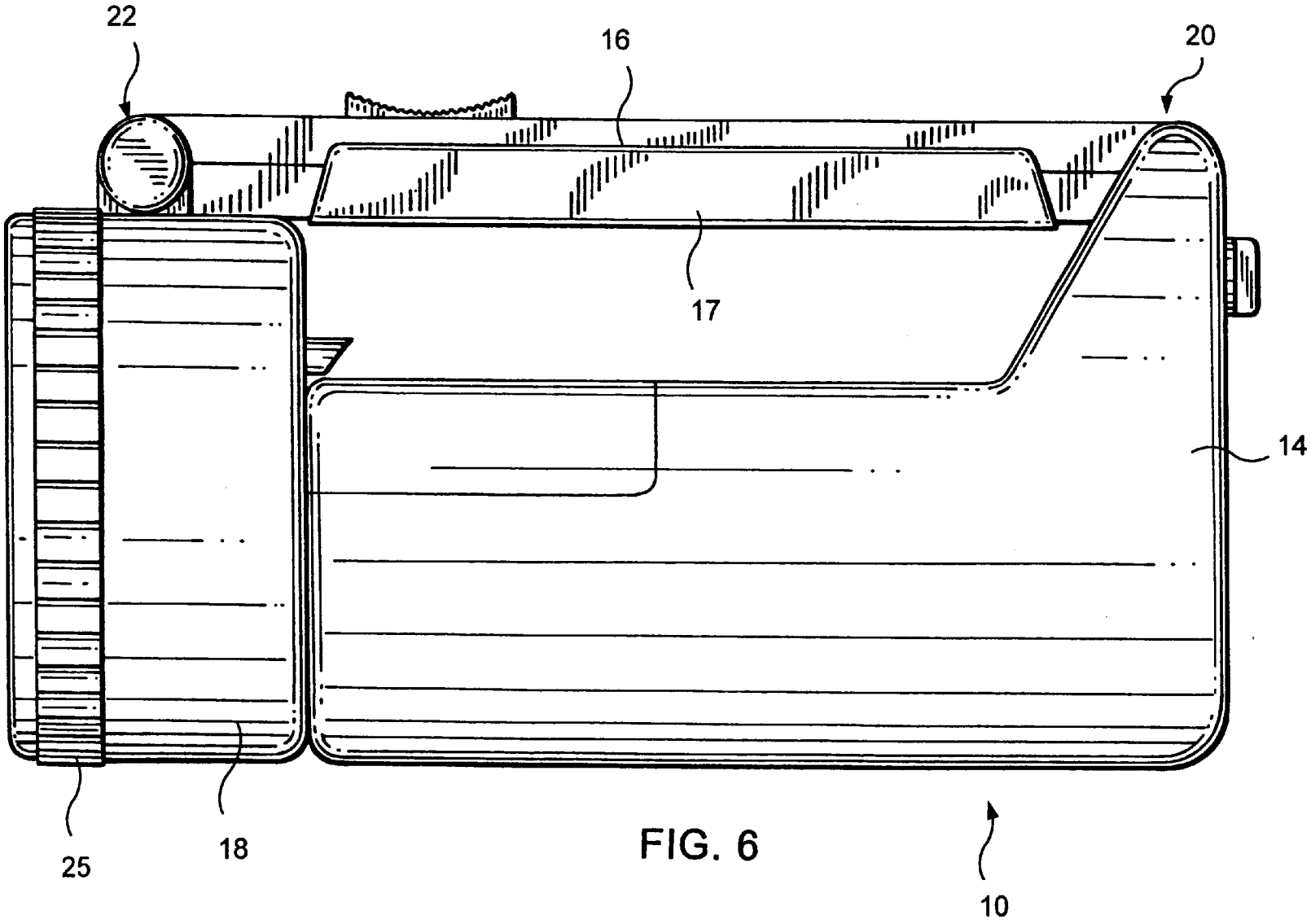
FIG. 6 is a right-side view thereof.

As FIG. 2 shows, the unit 10 is provided with a slide switch 24 having multiple positions, such as "dim," "bright," "off" and "blinker." It is within the scope of the invention to associate a particular configuration of the unit 10 described above with a particular switch position. For example, the "blinker" position of the switch 24 can be associated with the configuration illustrated in FIG. 7, or with another configuration of the first unit 10, in order to employ the light for a particular purpose, such as warning oncoming traffic in the event of the breakdown of a vehicle on the highway. The configuration of FIG. 7 places the light head 18 at a suitable elevation above the roadway or other supporting surface to improve its visibility.

As another example, the "dim" position of the switch 24 can be associated with the configuration illustrated in FIG. 13. This adapts the light for use as a floodlight at close range, as for illuminating a table top at a campsite. In one embodiment of the invention, a ring 25 can be used to establish the floodlight mode of operation. The "dim" position provides the advantage of extending battery and bulb life.

As a third example, the "bright" position of the switch 24 can be associated with the configuration illustrated in FIG. 1. This adapts the light for use as a spotlight at long range, as in finding a house number from a car, inspecting a shoreline from a boat, or hiking through the woods. In one embodiment of the invention, the ring 25 can be used to establish the spotlight mode of operation.

Those skilled in the art will understand that many other associations can be made between the several positions of the switch 24 and the myriad configurations of which the first unit 10 is capable, and that it is within the scope of the invention to select any position of the switch 24 and any configuration of the unit 10 independently of each other. That is, any position of the switch 24 can be associated with any configuration of the unit 10, so that the apparatus can easily be employed in a flashlight, blinker or lamp mode.

Figure 7A:
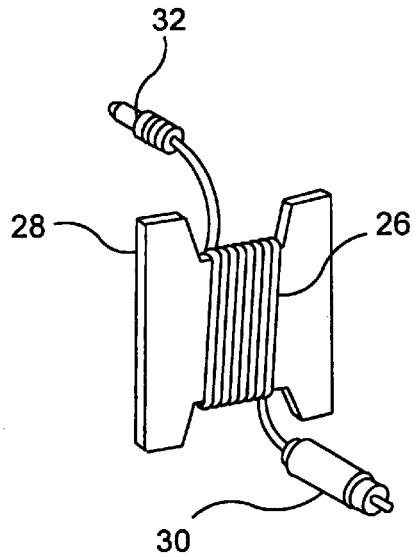
FIG. 7A is a perspective view of a power cord that can be stored within the first lighting unit.
Figure 7:
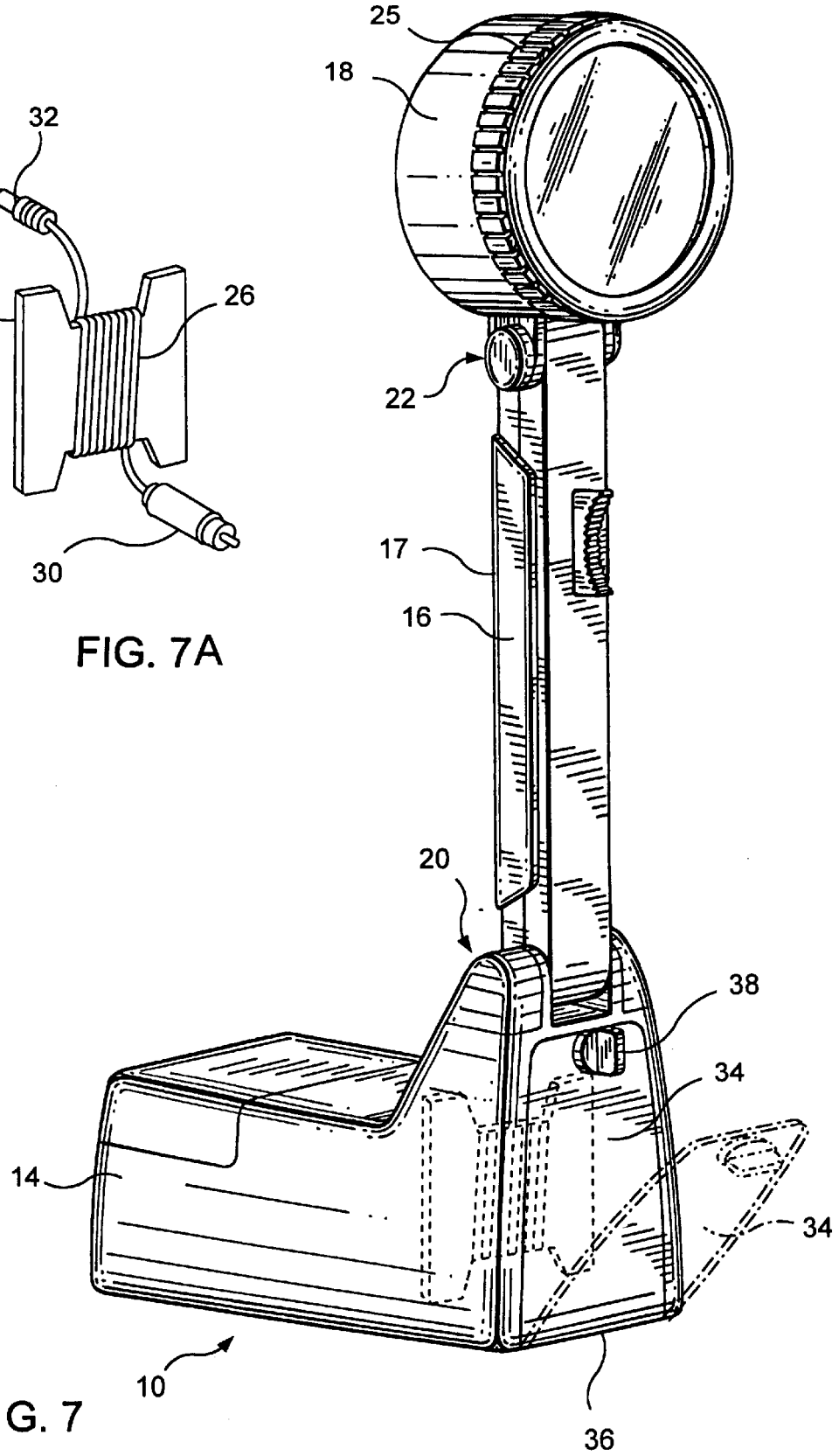
FIG. 7 is a top-rear-right perspective view thereof, showing the first unit in a second configuration.
Figure 8:
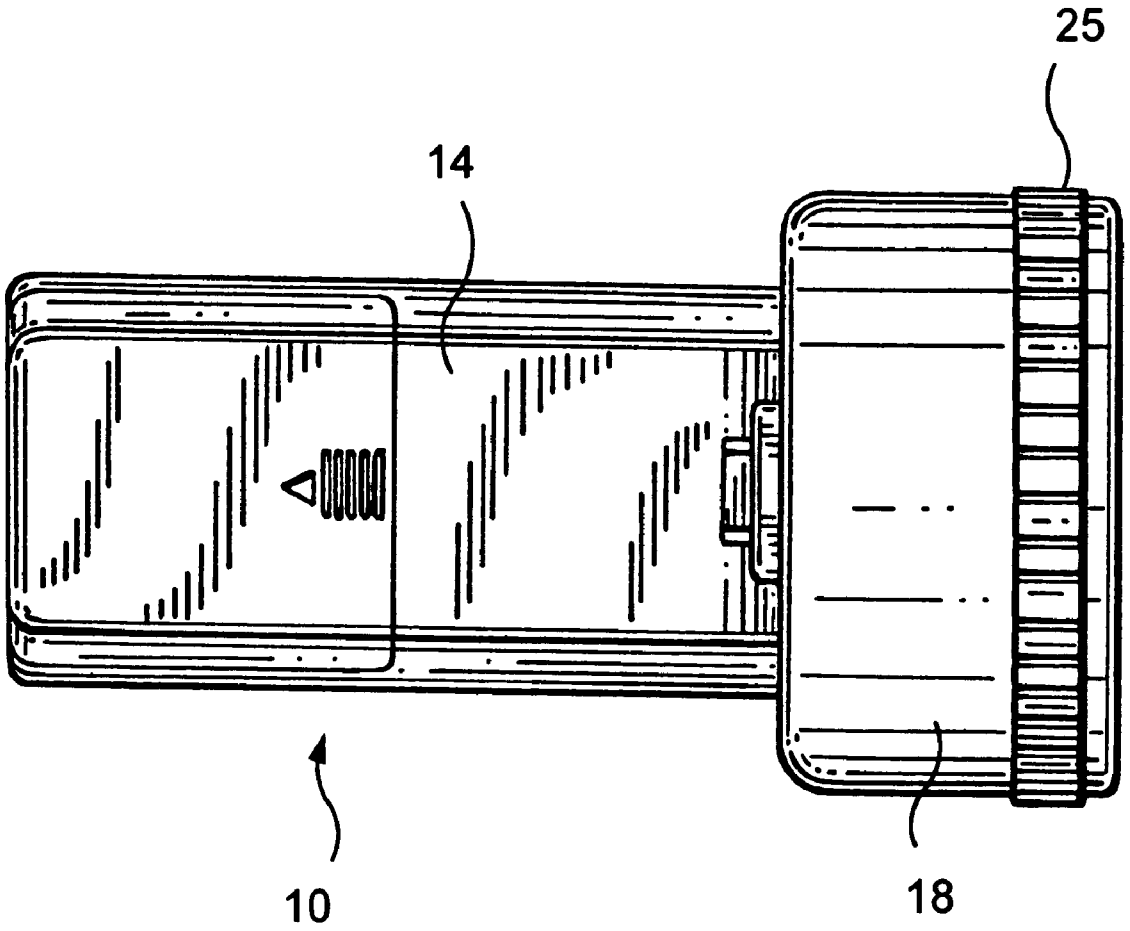
FIG. 8 is a top view corresponding to FIG. 7.
Figure 9:
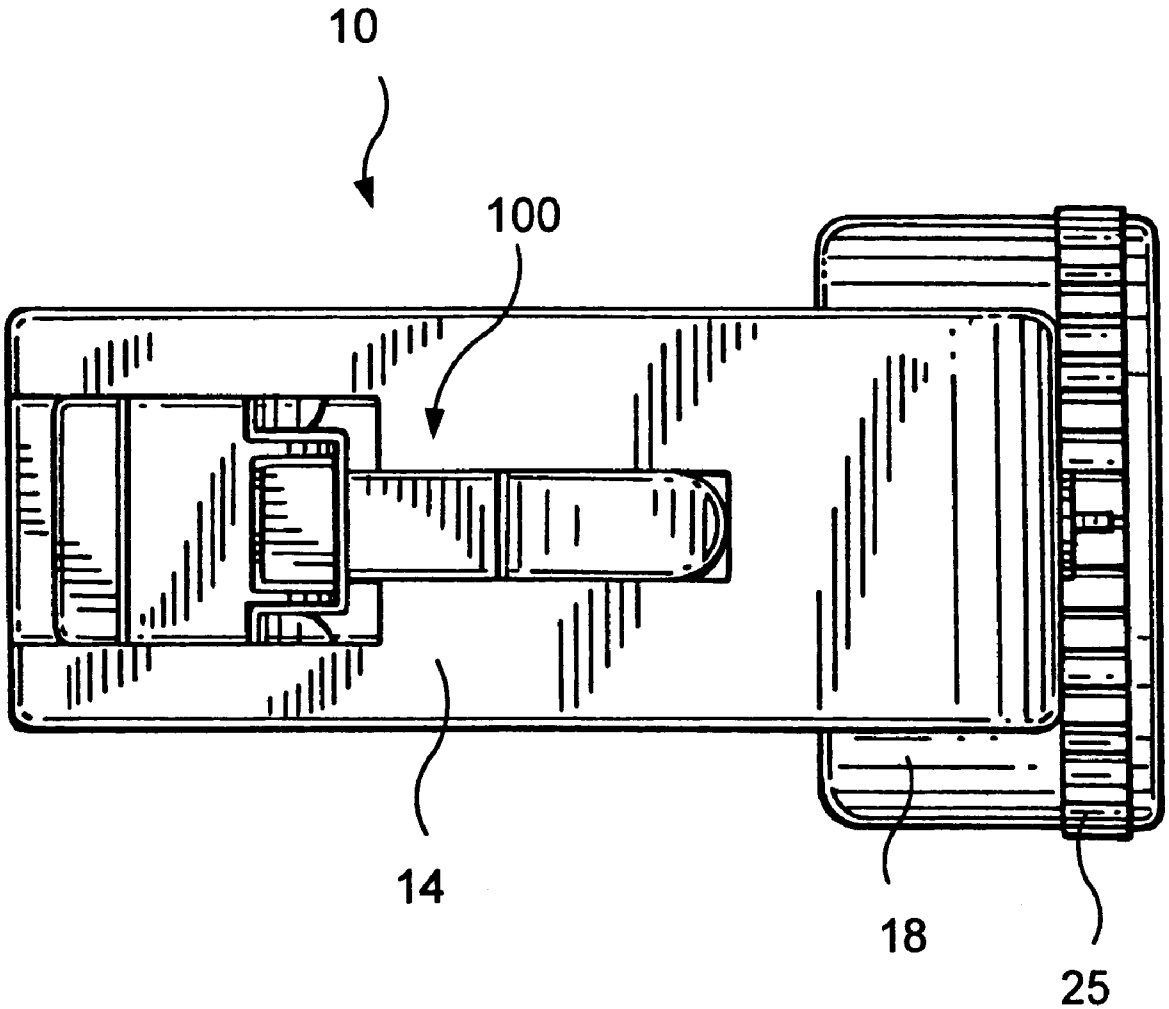
FIG. 9 is a bottom view corresponding to FIG. 7 and showing both lighting units.
Figure 10:
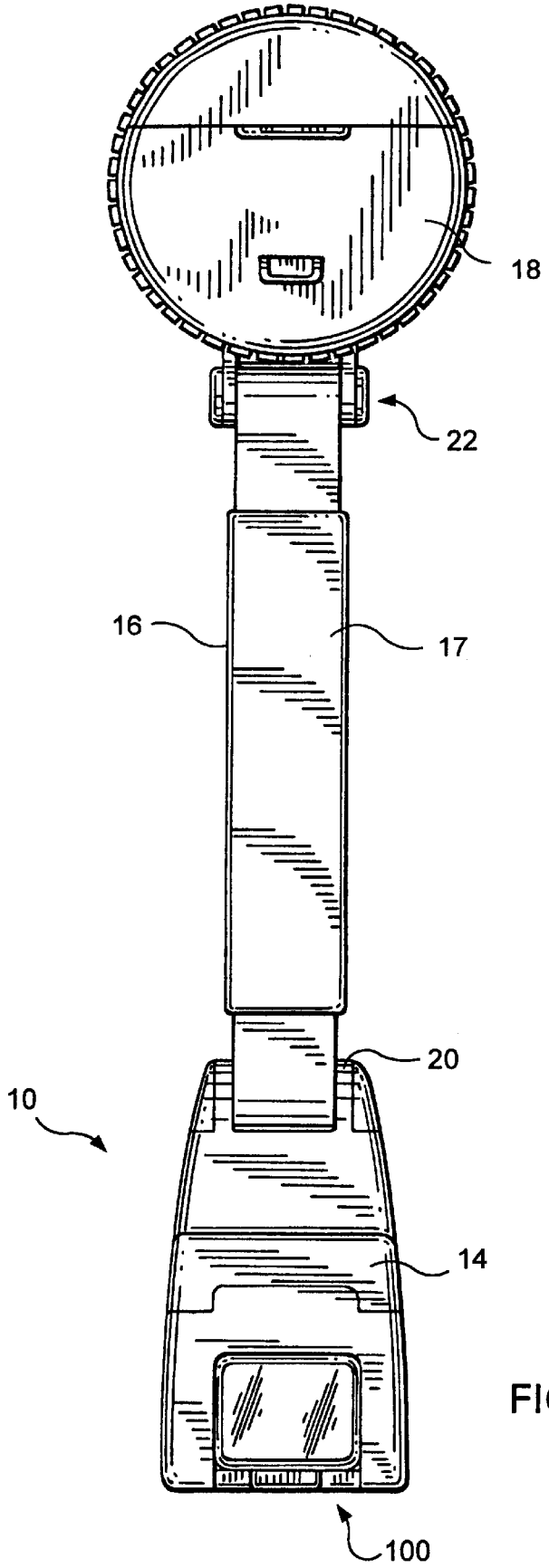
FIG. 10 is a front view corresponding to FIG. 7 and showing both lighting units.
Figure 11:
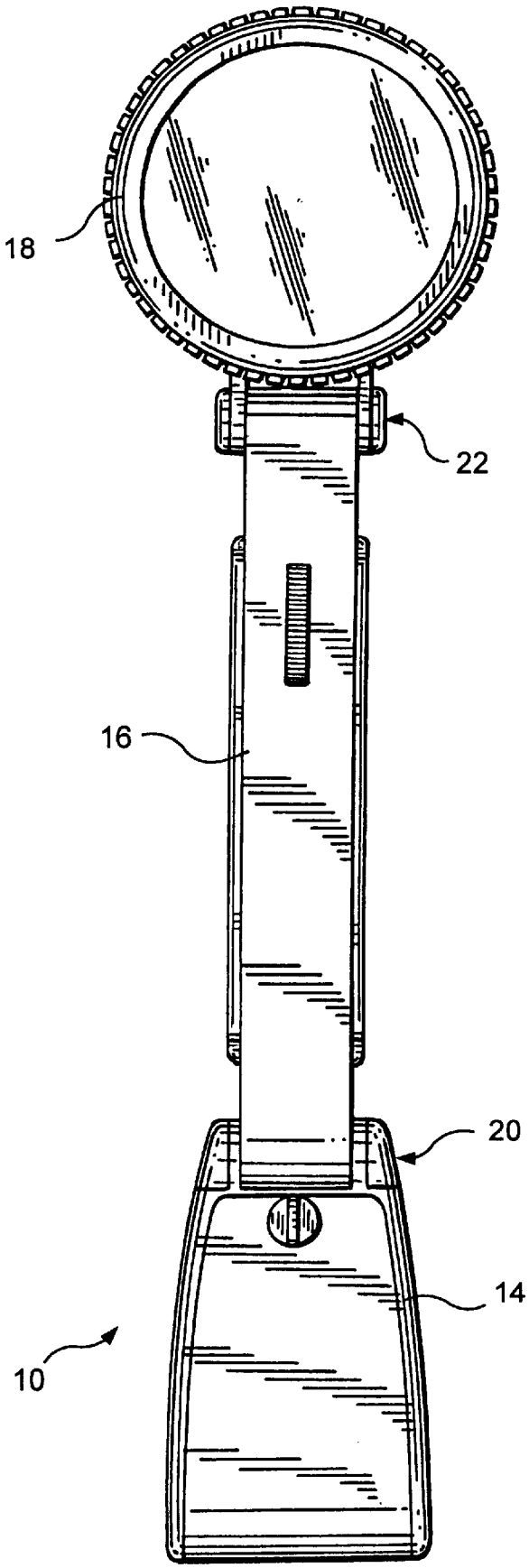
FIG. 11 is a rear view corresponding to FIG. 7.
Figure 12:
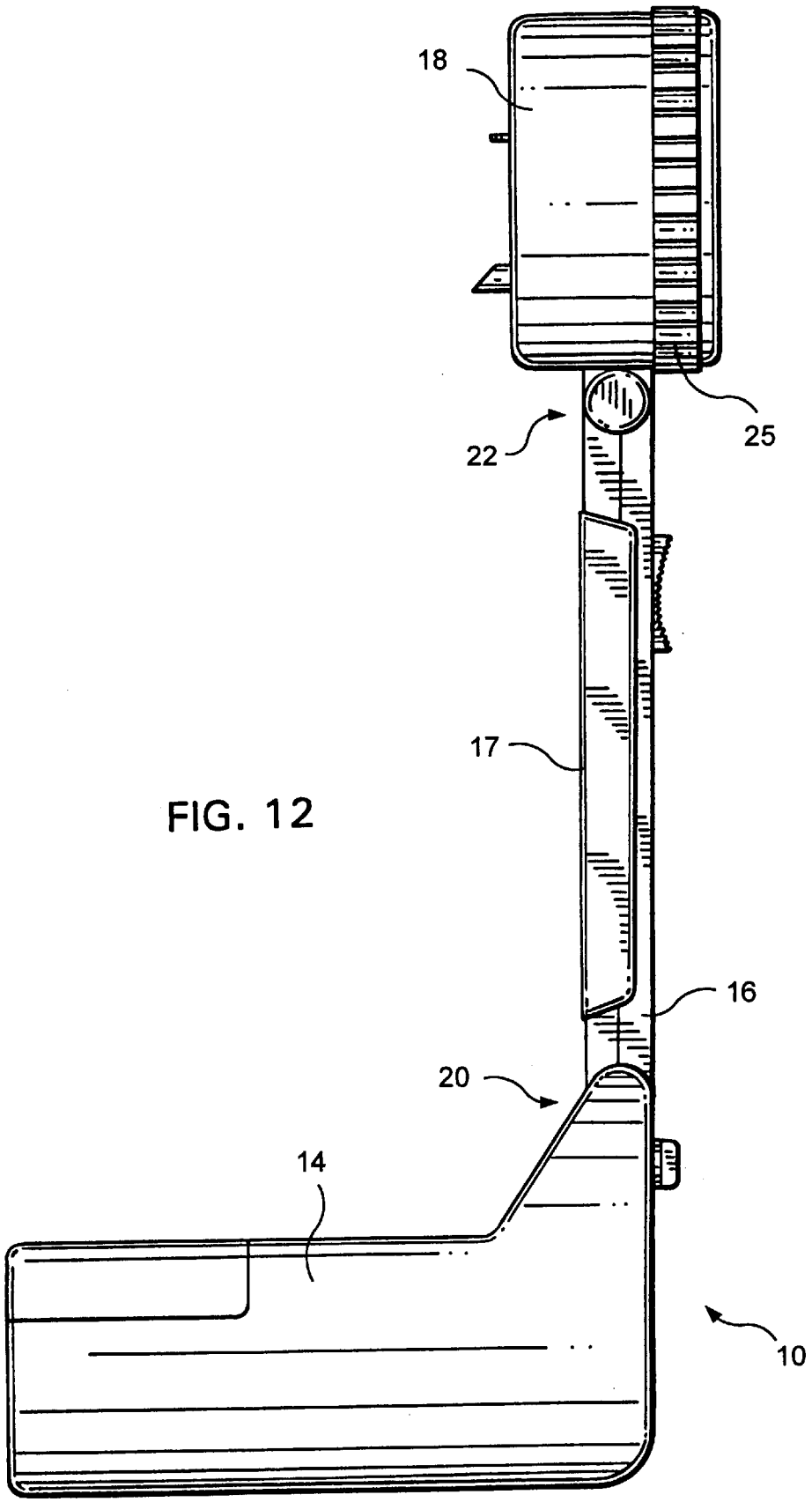
FIG. 12 is a right-side view corresponding to FIG. 7.

The unit can be powered by one or more batteries that are rechargeable or not. In a preferred embodiment of the invention, the unit 10 can be powered by the main battery of an automotive vehicle through a cigar lighter. As FIG. 7A shows, an insulated, conductive, double wire 26 is wrapped around a flat reel 28 for storage and has a cigar-lighter plug 30 at one end for insertion into the cigar-lighter receptacle commonly provided in the dashboard of a car and a jack 32 at the other end for connection to the unit 10. When not needed to power the unit 10, the wire 26 is wrapped as illustrated in FIG. 7A and stored within the housing 14 in a compartment to which access is gained through a door 34. The door 34 is pivoted at the bottom about a pivot 36 and secured at the top by a latch 38. The door 34 can therefore be moved between closed and open positions respectively illustrated in FIG. 7 by solid and broken lines. When it is desired to power the light by a vehicle battery, the wire 26 is withdrawn from storage, unwound from the reel 28, and connected as described above. The wire 12 preferably is of substantial length, for example 12 feet, so that the unit 10 can be deployed at a substantial distance from the cigar-lighter receptacle. This enables use of the unit 10 while changing a front or rear tire or working under the hood of a car. A longer wire can be provided for use in buses and trucks.

In one embodiment of the invention, not illustrated, the unit 10 is provided with an adapter having a step-down transformer and a plug that can be inserted into an electrical receptacle supplying house current. House current then powers the unit 10 and can charge a rechargeable battery provided in the unit 10.

A major feature of the invention is the provision of a plurality of portable lighting units such as 10 and 100 in a single package 12 in such a manner that they can be used together or separately. While two such units are illustrated, it is within the scope of the invention to provide three or more such units. If, for example, three such units are provided, one can be relatively large and the others can be relatively small. The relatively small units may but need not be of the same size and design.

In the preferred embodiment of the invention, the unit 100 is substantially smaller and lighter than the unit 10 and can be slid into or out of a compartment or pouch 34 (FIG. 23). When the unit 100 is slid out of the pouch 34, it can be used independently as a convenient pocket light, either by the same person who uses the unit 10 or by a different person. The unit 100 has a housing 101. A clip 102 is provided on the housing 101 for clipping the unit 100 to a belt, a layer of cloth forming the outside of a pocket, etc.

The unit 100 preferably is provided with its own battery, which can be rechargeable or not. If both the unit 10 and the unit 100 are provided with rechargeable batteries, they can be connected by an electrical circuit when the unit 100 is slid into the pouch 34 so that recharging the battery or batteries of the unit 10 using, for example, house current or the apparatus of FIG. 7A automatically recharges the battery or batteries of the unit 100. It is also possible to provide a rechargeable battery for powering one unit, such as the unit 10, and a nonrechargeable battery for the other unit.

Figure 21:
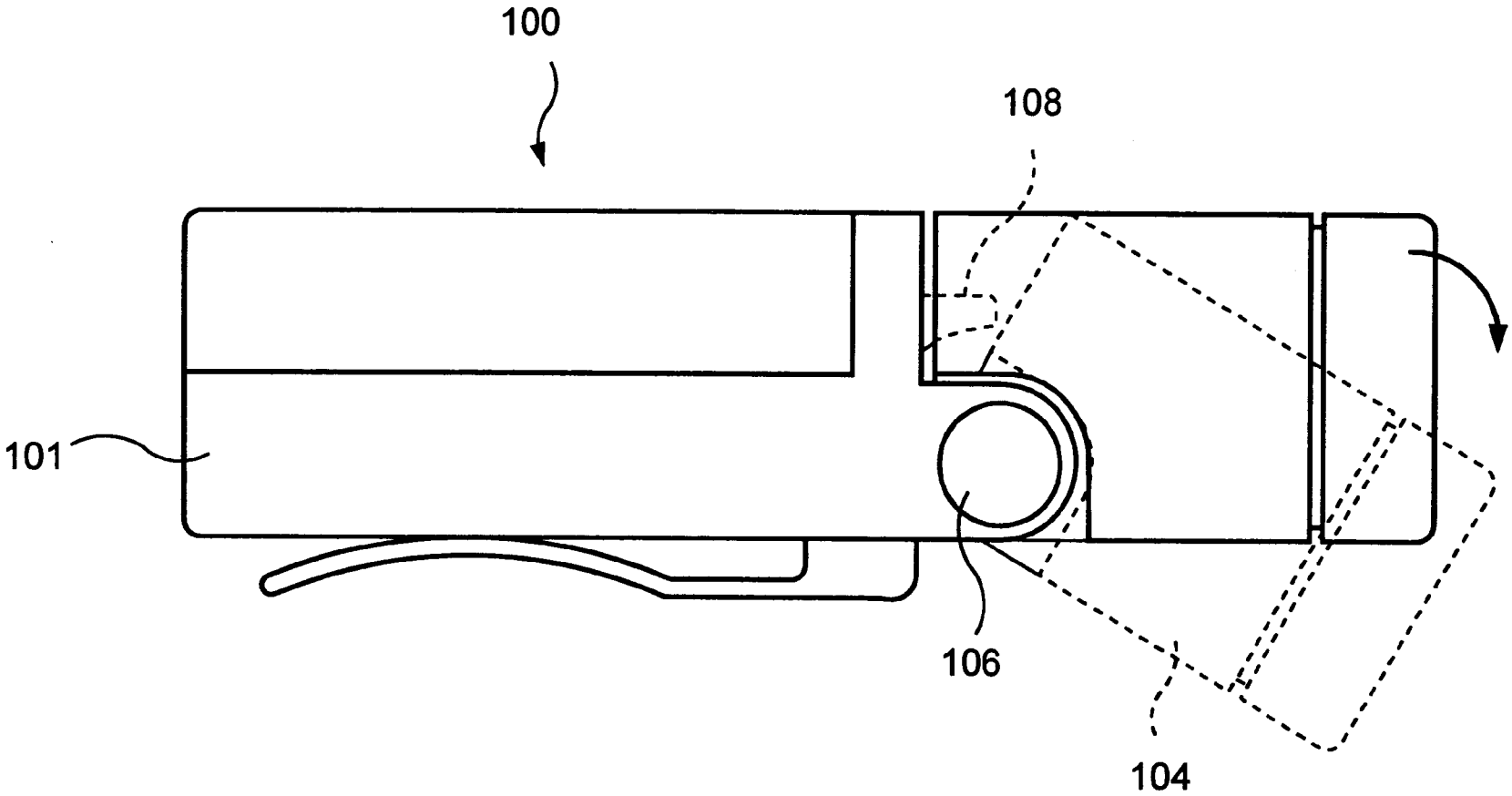
FIG. 21 is a left-side view thereof, showing the first and second configurations.

The unit 100 is turned on and off in one embodiment of the invention by tilting its head 104 down at a predetermined angle, for example about 40° relative to the horizontal, or to the direction of the longest dimension of the unit 100. To this end, the head 104 is pivoted at 106 (FIG. 21), and a spring-loaded switch control 108 moves out when the head 104 is pivoted from the position shown in solid outline to the position shown in dotted outline. The switch control 108 in the retracted position turns the unit 100 off and in the extended position turns the unit 100 on. It is thus possible to use the units 10 and 100 at the same time while carrying both by the handle 16. Then the unit 10 can be used to illuminate a trail, for example, at some distance ahead of a user of the apparatus, while the unit 100 illuminates the trail at close range. This enables the user to explore distant objects as an aid to navigation at night while maintaining easy surveillance of the terrain near the user's fee as an aid to avoiding any misstep.

The unit 100 can also have a manual switch for turning it on and off with the head 104 in either position.

Thus there is provided in accordance with the invention portable electric lighting apparatus that avoids the problems of the prior art and accomplishes the objects of the invention noted above. Many modifications of the preferred embodiments of the invention described above will readily occur to those skilled in the art. For example, lenses of different colors can be provided for the units 10 and 100 so that either or both can provide light in any desired band of the visible spectrum. Accordingly, the invention covers all embodiments thereof set out in the appended claims, and equivalents thereof.

What is claimed is:

1. Portable electric lighting apparatus comprising an electric lantern, a power source for powering the electric lantern, a mount for selectively deploying the electric lantern in one of a plurality of modes, a pocket flashlight detachably connected to the electric lantern, and a separate power source for powering the pocket flashlight.

2. Apparatus according to claim 1 that functions in one of the modes as a flashlight.

3. Apparatus according to claim 1 that functions in one of the modes as a lamp.

4. Apparatus according to claim 1 wherein the mount comprises a housing and an arm having a proximal end connected pivotally to the housing and a distal end connected to the light source, so that the arm can be pivoted to move the light source relative to the housing.

5. Apparatus according to claim 1 wherein the mount comprises a housing and the light source is pivotally connected to the housing, so that light emanating from the light source can be redirected.

6. Apparatus according to claim 1 wherein the mount comprises a housing and an arm having a proximal end connected pivotally to the housing and a distal end connected pivotally to the light source, so that the arm can be pivoted to move the light source relative to the housing and light emanating from the light source can be redirected.

7. Portable electric lighting apparatus comprising an electric lantern, a power source for powering the electric lantern, a mount for selectively deploying the electric lantern in one of a plurality of modes, and a pocket flashlight detachably connected to the electric lantern, wherein the apparatus functions in one of the modes as a blinker.

8. Portable electric lighting apparatus comprising an electric lantern, a power source for powering the electric lantern, a mount for selectively deploying the electric lantern in one of a plurality of modes, and a pocket flashlight detachably connected to the electric lantern, wherein the apparatus functions in one of the modes as a flashlight, in another of the modes as a blinker, and in another of the modes as a lamp and in another of the modes is turned off.

9. Apparatus comprising a first portable, battery-powered electric light including a first housing forming a pouch, and a second portable, battery-powered electric light insertable within the pouch to form a portable unit;

wherein the first light comprises a first light source, a first power source for powering the first light source, and an arm having a proximal end connected pivotally to the first housing and a distal end pivotally connected to the first light source, so that the arm can be pivoted to move the first light source relative to the first housing to any of a first position in which the first light functions as a flashlight, a second position in which the first light functions as a blinker, and a third position in which the first light functions as a lamp; and wherein the second light comprises a second housing, a second light source pivotally connected to the second housing to project light selectively in either of two directions relative to the second housing, and a second power source for powering the second light source.

10. Apparatus according to claim 9 wherein the first housing is elongate, and in the first position the arm is parallel to the first housing, in the second position the arm is perpendicular to the first housing, and in the third position the arm forms an acute angle with the first housing.

11. Apparatus according to claim 9 further comprising means storable within the first housing and deployable for connection to a cigar-lighter receptacle of an automotive vehicle for powering the first electric light.

12. A pocket flashlight having a housing and a head that can be pivoted relative to said housing between two positions, in one of which the flashlight is turned off and in the other of which the flashlight is turned on.

* * * * *